US005234291A

United States Patent [19]

Swemmer

[11] Patent Number: 5,234,291

[45] Date of Patent: Aug. 10, 1993

[54] ROOF BOLTS

[75] Inventor: Theodore D. Swemmer, Transvaal, South Africa

[73] Assignee: Hugo Trustees, Channel Islands

[21] Appl. No.: 864,529

[22] Filed: Apr. 7, 1992

[30] Foreign Application Priority Data

Apr. 9, 1991 [ZA] South Africa ..... 91/2615

[51] Int. Cl.[5] ..... E21D 21/02

[52] U.S. Cl. ..... 405/259.1; 405/258; 411/3; 411/417; 470/10

[58] Field of Search ..... 411/2, 3, 5, 417, 418, 411/420, 421; 405/258, 259.1, 259.2; 470/9, 10, 11, 12

[56] References Cited

U.S. PATENT DOCUMENTS

| | | | |
|---|---|---|---|
| 250,134 | 11/1881 | Coy | 470/11 X |
| 332,359 | 12/1885 | Paine | 411/417 X |
| 1,327,934 | 1/1920 | Alcock | 411/417 X |
| 2,562,516 | 7/1951 | Williams | 470/11 |
| 3,218,656 | 11/1965 | Reiland | 411/418 X |
| 3,460,428 | 8/1969 | Charles | 411/2 |
| 4,247,224 | 1/1981 | Killmeyer | 405/260 |
| 4,325,657 | 4/1982 | Elders | 405/259.1 X |
| 4,630,971 | 12/1986 | Herbst et al. | 405/259.1 X |
| 4,971,493 | 11/1990 | Herbst et al. | 405/259.1 X |

FOREIGN PATENT DOCUMENTS

| | | | |
|---|---|---|---|
| 3403688 | 9/1985 | Fed. Rep. of Germany | 405/259.1 |
| 89/5463 | 7/1989 | South Africa . | |
| 89/5464 | 7/1989 | South Africa . | |
| 1078094 | 3/1984 | U.S.S.R. | 405/259.1 |
| 1420174 | 8/1988 | U.S.S.R. | 405/259.1 |

OTHER PUBLICATIONS

Automatic Machining, pp. 46–47, Jul. 1957.

*Primary Examiner*—Dennis L. Taylor
*Assistant Examiner*—Arlen L. Olsen
*Attorney, Agent, or Firm*—Ladas & Parry

[57] ABSTRACT

The roof bolt tendon comprises a length of square twist steel with a partial thread formed directly thereon over at least part of its length. The partial thread, which may extend for the full length of the tendon and which is preferably formed by rolling, is composed of thread portions formed at the corners of the square cross-section of the square twist steel. A roof bolt in which the tendon is employed is also disclosed.

6 Claims, 1 Drawing Sheet

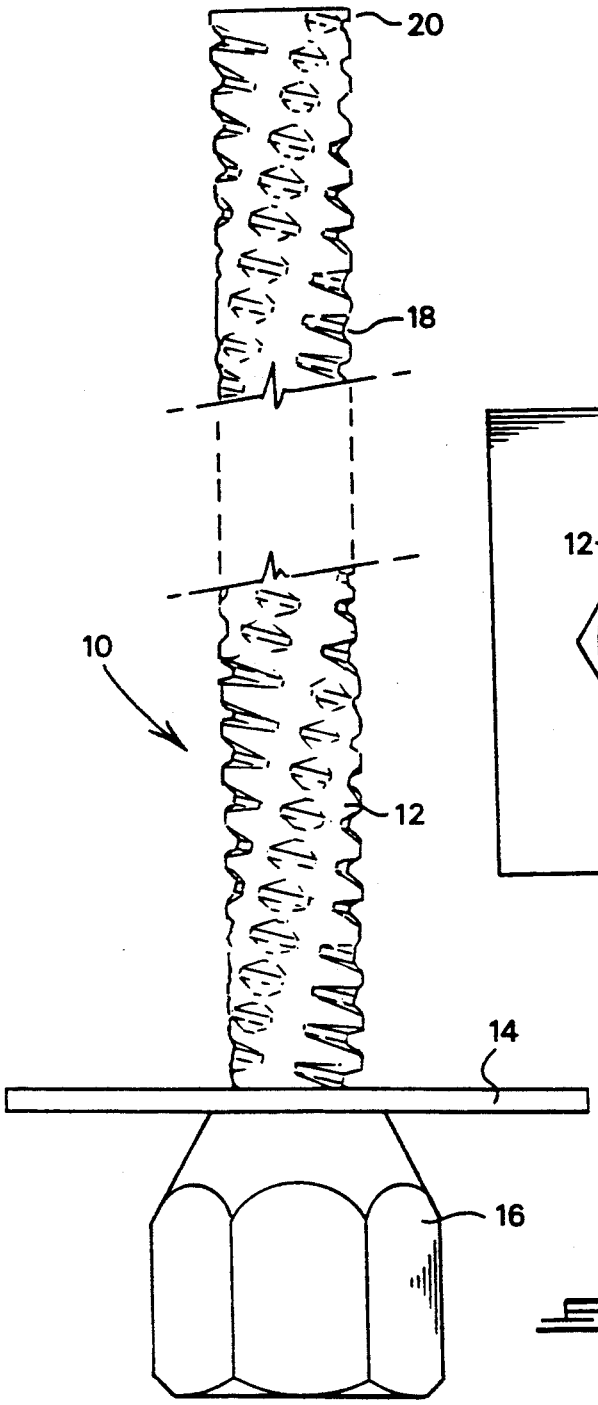
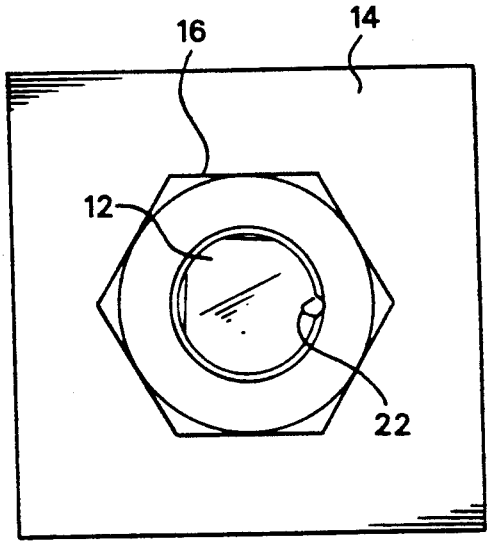
FIG 2
FIG 1

ROOF BOLTS

BACKGROUND TO THE INVENTION

This invention relates to roof bolts.

It has already been proposed to use, as the tendon in a roof bolt, a length of square twist steel, file. A length of square steel bar twisted about its longitudinal axis. In general, the tendon of a roof bolt must have a threaded, operatively outer end that will project from the drilled hole in a rock formation to take a nut which is used to clamp a washer against the periphery of the mouth of the hole.

SUMMARY OF THE INVENTION

According to the present invention, a roof bolt tendon comprises a length of square twist steel with a partial thread formed directly thereon over at least part of tis length, the partial thread being composed of thread portions formed at the corners of the square cross-section of the square twist steel. The partial thread is typically formed by rolling.

In one embodiment of the invention, the partial thread is formed over the full length of the tendon.

Further according to the present invention, a method of making a roof bolt tendon comprises providing a tendon in the form of a length of square twist steel and rolling a partial thread directly onto the tendon over at least a part of the length of the tendon, the rolled thread being composed of thread portions formed at the corners of the square cross-section of the square twist steel.

The invention extends to a roof bolt comprising a roof bolt tendon as summarised above and a nut engagable in threaded fashion with the partial thread, one end of the nut being deformed to provide a projection which engages the operatively outer end f the tendon and prevents the nut from being threaded along the partial thread until a predetermined torque has been applied to the nut, at which stage the projection is deformed or broken by the end of the tendon to permit such threaded movement of the nut.

BRIEF DESCRIPTION OF THE DRAWINGS

The invention will now be described in more detail, by way of example only, with reference to the accompanying drawings in which:

FIG. 1 shows a side view of a roof bolt of the invention; and

FIG. 2 shows an end view of the roof bolt seen in FIG. 1.

DESCRIPTION OF A PREFERRED EMBODIMENT

The illustrated roof bolt 10 consists of a roof bolt tendon 12, a washer 14 and a nut 16. The roof bolt tendon 12 is provided by a length of square twist steel, i.e. a length of square steel bar twisted about its longitudinal axis. In this case, the square twist is produced by a cold twisting process.

What is not conventional about the illustrated roof bolt is the fact that the tendon 12 is formed with a partial thread 18, in this case extending of the full length of the tendon. In other cases, merely an operatively outer portion of the length of the tendon, i.e. The lower end in FIG. 1, may e formed with the partial thread.

The partial thread 18 is formed by a cold thread rolling process using a conventional plunge rolling machine. The machine is set to roll the desired thread only into the corners of the squares cross-section of the tendon as illustrated. Thus it will be noted in the illustrated embodiment that the thread 18 is not continuous about the full periphery of the tendon, and exists merely at the corners of the square cross-section.

The partial thread 18 that results is however quite sufficient for threaded engagement by the nut 16 and provides adequate purchase for substantial torque to be applied to the nut during setting of the roof bolt.

The fact that the thread is not continuous means that first is cleaned by the nut when the nut is threaded onto it.

In use, a hole is drilled into a rock formation which is to be bolted with the bolt 10. A grout bag is inserted into the hole and the operatively inner end 20 of the tendon 12, i.e. The upper end in FIG. 1, is rammed into the hole to rupture the grout bag. The tendon is then rotated, possibly using a rock drill, in the appropriate sense of the square twist to drive the grout to the bottom of the hole and to mix the components thereof.

Referring to FIG. 2, it will be seen that the operatively outer end of the nut, i.e. The lower end in FIG. 1, is deformed, for instance by application of a punch, to have an inwardly directed nib projection 22 which extends into the hollow of the nut. Clearly, this nib projection will initially prevent threaded movement of the nut along the partial thread 18. Thus in the rotation of the tendon as described above, it is possible to apply the scanner or other device which is used to rotate the tendon to the nut itself, since the action of the nib projection is such that initial rotation of the nut will result in simultaneously rotation of the tendon.

After the grout has set to a certain extend, such that a torque higher than a predetermined torque limit must be applied to the nut to rotate the tendon further, the nib projection is deformed or broken off by the end of the tendon to allow the nut to move along the partial thread 18. Thus with the further application of rotational torque in the same sense as before, the nut moves along the tendon and drives the washer against the rock formation about the periphery of the mouth of the drilled hole. It will be appreciated that the hand of the thread 18 will be chosen in accordance with the direction of rotation of the tendon, if the same rotational drive is to be used to thread the nut along the tendon.

In general, mixing of the group components is facilitated if the thread is of opposite hand to the twist in the tendon. Thus in FIG. 1 the tendon is designed for a right hand twist direction nd the partial thread 18 is a left hand thread.

An advantage of the illustrated roof bolt is the face that the partial thread 18 can be formed relatively easily with conventional thread rolling machinery and with little damage to that machinery. Typically, the partial thread 18 will e designed or threaded engagement by a nut having a standard Acme or ISO metric thread, although other standard or non-standard threads and sizes may also be used, depending on the circumstances.

I claim:

1. A roof bolt tendon comprising a length of square twist steel with a partial thread formed by rolling directly thereon over at least part of its length, the partial thread being composed of thread portions formed at the corners of the square cross-section of the square twist steel and the twist in the square twist steel being of opposite hand to the partial thread.

2. A roof bolt tendon according to claim 1 wherein the partial thread is formed over the full length of the tendon.

3. A roof bolt comprising a roof bolt tendon according to claim 1 and a nut engagable in threaded fashion with the partial thread, one end of the nut being deformed to provide a projection which engages the operatively outer end of the tendon and prevents the nut from being threaded along the partial thread until a predetermined torque has been applied to the nut, at which stage the projection is deformed or broken by the end of the tendon to permit such threaded movement of the nut.

4. A roof bolt according to claim 3 wherein the reaction is in form of a nib projection into the hollow of the nut.

5. A method of making a roof bolt tendon comprising providing a tendon in the form of a length of square twist steel and rolling a partial thread directly onto the tendon over at least a part of the length of the tendon, the rolled thread being composed of thread portions formed at the corners of the square cross-section of this square twist steel and the twist in the square twist steel being of opposite hand to the partial thread.

6. A method according to claim 5 wherein the partial thread is formed over the full length of the tendon.

* * * * *